US005975993A

United States Patent [19]

Isoda et al.

[11] Patent Number: 5,975,993

[45] Date of Patent: Nov. 2, 1999

[54] METHOD OF MANUFACTURING DEVELOPING ROLLER

[75] Inventors: Masao Isoda; Hirokazu Ando; Takao Mizutani; Tutomu Shimoda, all of Tokyo, Japan

[73] Assignee: Oki Data Corporation, Tokyo, Japan

[21] Appl. No.: 08/911,791

[22] Filed: Aug. 15, 1997

[30] Foreign Application Priority Data

Aug. 21, 1996 [JP] Japan ..... 8-219715

[51] Int. Cl.[6] ..... B24B 1/00

[52] U.S. Cl. ..... 451/49; 451/57

[58] Field of Search ..... 451/49, 57

[56] References Cited

U.S. PATENT DOCUMENTS

| | | | |
|---|---|---|---|
| 4,841,683 | 6/1989 | Williams | 51/142 |
| 4,932,165 | 6/1990 | Sone et al. | 51/281 R |
| 5,148,639 | 9/1992 | Sakai et al. | 51/328 |
| 5,610,695 | 3/1997 | Mizutani et al. | 399/284 |
| 5,725,922 | 3/1998 | Nakamura et al. | 428/36.9 |

FOREIGN PATENT DOCUMENTS

| | | |
|---|---|---|
| 8-82995 | 3/1996 | Japan . |

*Primary Examiner*—David A. Scherbel
*Assistant Examiner*—Dung Van Nguyen
*Attorney, Agent, or Firm*—Akin, Gump, Strauss, Hauer & Feld, L.L.P.

[57] ABSTRACT

A method of manufacturing a developing roller includes two steps. First, a grinding wheel is moved along the length of a developing roller which has been subjected to a secondary vulcanization. The grinding wheel is brought into contact with the developing roller and is caused to rotate so as to perform an abrasive finishing on the surface of the developing roller. Second, a buffing member is moved along the length of the developing roller. The buffing member is in contact with the developing roller and is moved in the peripheral direction of the developing roller so as to perform buffing on the surface of the developing roller.

5 Claims, 6 Drawing Sheets

METHOD OF MANUFACTURING DEVELOPING ROLLER

BACKGROUND OF THE INVENTION

1. Field of the Invention

The present invention relates to a method of manufacturing a developing roller.

2. Description of Related Art

In conventional electrophotographic printers, the surface of a photosensitive drum is uniformly charged by a charging device. An exposing device emits light which illuminates the charged surface to form an electrostatic latent image on the surface. The electrostatic latent image is subsequently developed into a toner image by a developing device. The toner image is then transferred to a print medium. The print medium is subsequently fed to a fixing device where the toner image on the print medium is fused. The developing device includes a developing roller and a toner tank in which toner is held. The toner is applied to the surface of the photosensitive drum by the developing roller.

Conventional developing rollers use a resilient rubber-like material such as urethane or silicone as a matrix, mixed with a powdered resin such as silicone balls, silica, or glass pieces. These fine powdered resins have diameters in the range of 1 to 50 $\mu$m.

The conventional developing roller is manufactured as follows:

A rubber matrix of 100 parts and a powdered resin of 130 parts having a particle diameter in the rage of 1 to 50 $\mu$m are mixed together. The mixture is then kneaded. Thereafter, curing agent is added to the kneaded mixture and the mixture is further kneaded. The thus obtained material is then formed into a sheet as a sheeting material.

The sheeting material and an adhesive are applied to a shaft and the shaft is placed in a mold so that the sheeting material is subsequently shaped into a roller. Then the roller is subjected to coarse polishing to remove excessive sheeting material projecting from ends of the shaft. The coarsely polished roller is then subjected to secondary vulcanization, abrasive finishing, and final cleaning successively. After having cleaned finally, the roller is examined before shipping.

During the abrasive finishing, the coarsely polished roller is further polished to a predetermined diameter and a predetermined surface roughness so that the necessary amount of toner is applied to the photosensitive drum.

However, with the aforementioned conventional method of manufacturing a developing roller, particles of powdered resin are ground off the roller together with some of the matrix during the abrasive finishing. As a result, a sufficient number of particles of powdered resin are not left exposed on the surface of the roller. When the surface of the developing roller is ground, the matrix such as rubber plastically stretches to cover the particles of powdered resin as depicted by A–F in FIG. 11, so that the particles will be left partially covered after the roller has been cleaned. Therefore, a sufficient number of particles of powdered resin will not appear on the surface of the roller. Referring to FIG. 11, the particles are exposed as depicted by black areas A–F and covered as depicted by white areas a–f adjacent to the black areas A–F.

As a result, a new, unused developing roller has an insufficient surface roughness, allowing a correspondingly less amount of toner to be deposited on the roller surface. A larger number of particles of powdered resin will appear on the surface of the developing roller reaching a certain number of particles as a larger number of printing operations are performed. Therefore, more amount of toner adheres to the developing roller.

Thus, there will be a difference in print density between a new, unused developing roller and a roller having been used to print, for example, about 5,000 pages of paper.

SUMMARY OF THE INVENTION

The present invention was made in view of the aforementioned drawbacks of the prior art developing roller. An object of the invention is to provide a method of manufacturing a developing roller in which the print density obtained in early printing operations is still maintained after having performed a predetermined large number of printing operations.

Another object of the invention is to provide a method of manufacturing a developing roller formed of a rubber matrix with powdered resin material mixed therein.

A method of manufacturing a developing roller includes two steps. First, a grinding wheel is moved along the length of a developing roller which has been subjected to a secondary vulcanization. The grinding wheel is brought into contact with the developing roller and is caused to rotate so as to perform an abrasive finishing on a surface of the developing roller. Second, after grinding, a buffing member is moved along the length of the developing roller. The buffing member is in contact with the developing roller and is moved in the peripheral direction of the developing roller so as to perform buffing on the surface of the developing roller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The present invention will become more fully understood from the detailed description given hereinbelow and the accompanying drawings which are given by way of illustration only, and thus are not limitative of the present invention, and wherein.

DESCRIPTION OF THE INVENTION

The present invention will be described in detail with reference to the accompanying drawings.

First embodiment

Figure 1A:
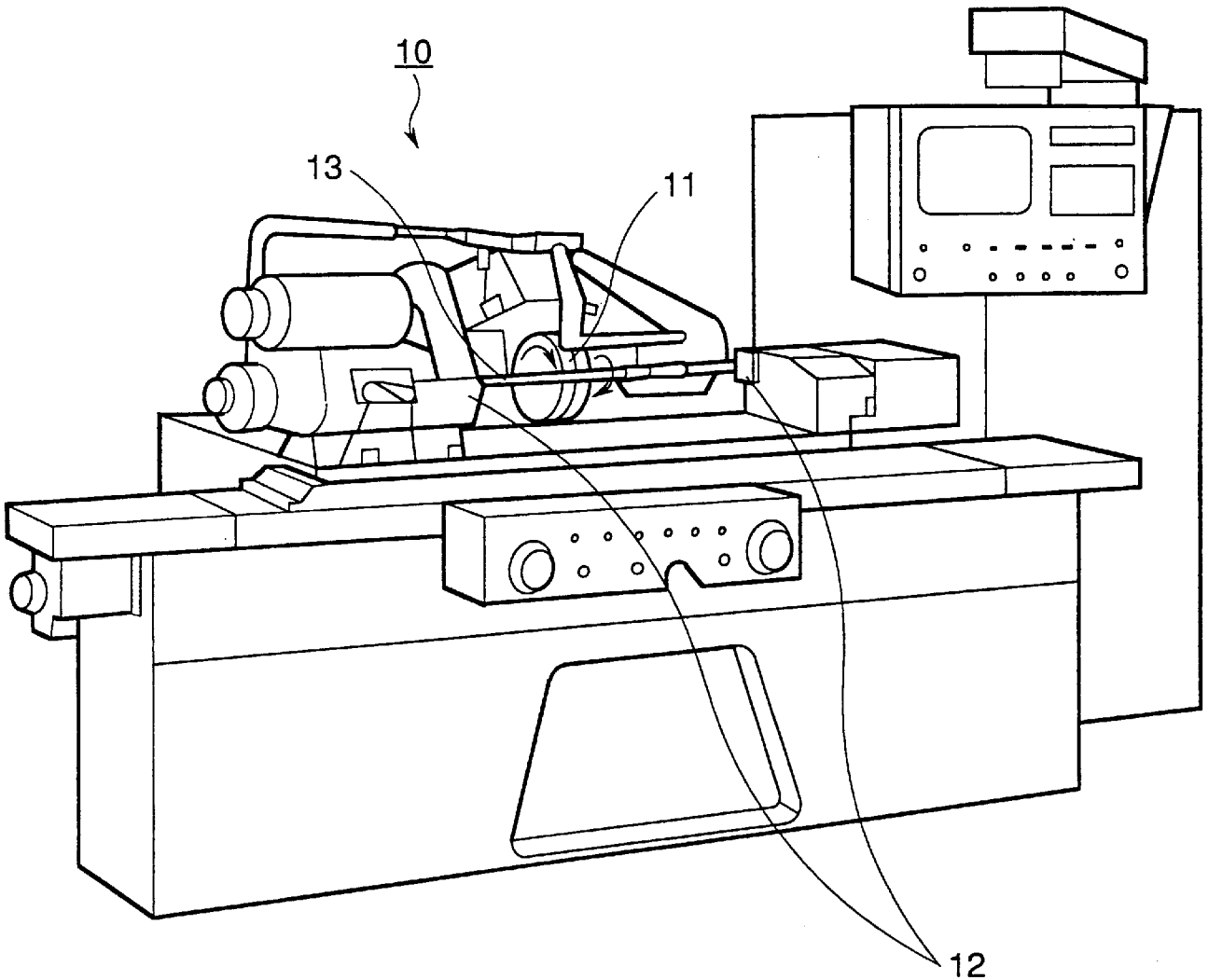
FIG. 1A is a perspective view of a cylindrical grinder on which a developing roller is attached for grinding operation.
Figure 1B:
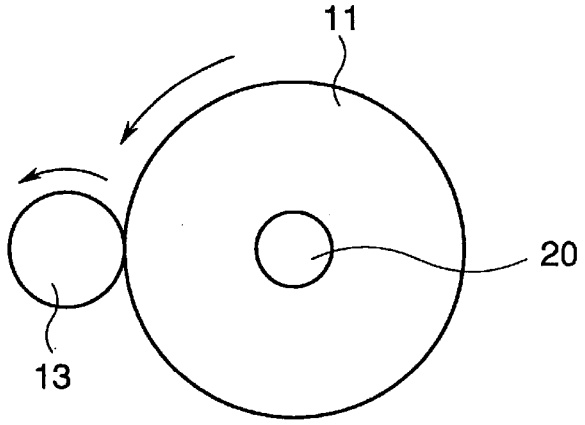
FIG. 1B is a side view showing the developing roller being subjected to abrasive polishing performed by a grinding wheel.

FIG. 1A is a perspective view of a cylindrical grinder on which a developing roller is attached for grinding operation. FIG. 1B is a side view showing the developing roller being subjected to abrasive polishing performed by a grinding wheel.

An intermediate assembly of a developing roller or coarsely ground developing roller is manufactured using powdered resin (e.g. 1–50 μm) and rubber matrix as follows:

A matrix of silicone rubber of 100 parts is mixed with silicone balls of 130 parts. The silicone balls are of about 15 μm in diameter. The mixture is then kneaded. Thereafter, a curing agent is added to the kneaded mixture and the mixture is further kneaded. The thus obtained material is then formed into a sheet as a sheeting material, not shown.

An adhesive is applied to a shaft, not shown, and then the sheeting material so that the shaft is wrapped around by the sheeting material. Then, the entire assembly is placed in a mold so that the sheeting material is subsequently shaped into a roller. Then, the roller is subjected to coarse polishing to remove excessive sheeting material projecting from the ends of the shaft. The coarsely polished roller 13 is then subjected to secondary vulcanization, and is left as it is for about 24 hours.

Then, the roller 13 is subjected to abrasive polishing.

The roller 13 is set on a work-holding fixture 12 of the cylindrical grinder 10. When the roller 13 rotates, the grinding wheel 11 moves along the length of the roller 13 performing final polishing. The roller 13 rotates at a speed of 138 rpm and the grinding wheel 11 rotates at a peripheral speed of 1800 m/min in the same direction as the roller 13, so that the the surface of the roller 13 and the surface of the grinding wheel 11 run in opposite directions at a location where they oppose each other.

Figure 2:
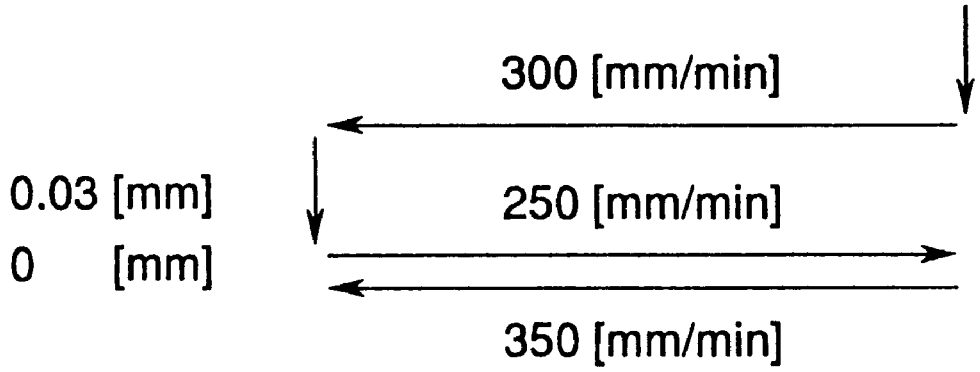
FIG. 2 shows how the developing roller is ground by an abrasive wheel.

FIG. 2 shows how the developing roller is ground by the grinding wheel. As shown in FIG. 2, the grinding wheel 11 is pressed against the roller 13 with a predetermined grain depth of cut. The grinding wheel 11 is #GC150, porous type. The grinding wheel 11 is then moved leftward along the length of the roller 13 at a speed of 300 mm/min. The grinding wheel 11 is subsequently pressed against the roller 13 with a depth of cut of 0.03 mm, smaller than the predetermined depth of cut, and is moved along the roller 13 at a speed of 250 mm/min. Finally, the grinding wheel is again moved leftward with a depth of cut of zero mm along the roller 13 at a speed of 350 mm/min.

Figure 3:
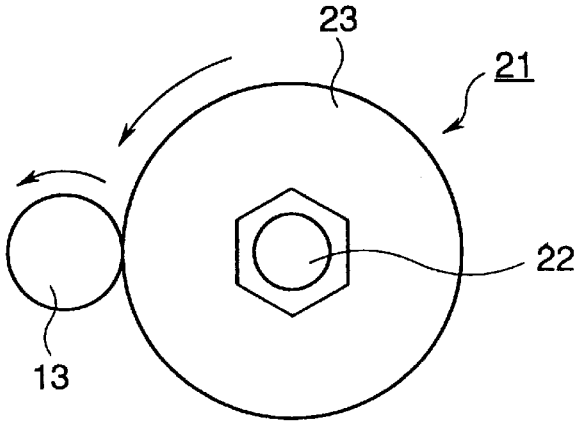
FIG. 3 is a side view showing a developing roller being polished by a buffing operation.
Figure 4:
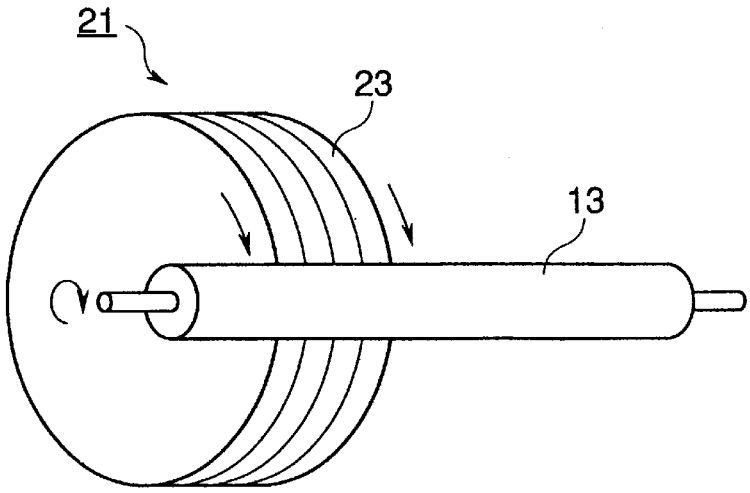
FIG. 4 is a perspective view showing a developing roller being polished by the buffing operation.

FIGS. 3 and 4 illustrate a developing roller being polished by a buffing, FIG. 3 being a side view and FIG. 4 being a perspective view.

After grinding has been completed, the grinding wheel 11 is replaced by a brush type buffing wheel 21 shown in FIGS. 3 and 4. The roller 13 is rotated on its axis. The buffing wheel 21 is moved, while rotating, along the length of the rotating roller 13 so as to perform buffing.

The buffing member 21 includes a plurality of discs of lapping wheels 23 aligned on a shaft 22. The lapping wheel 23 is made by impregnating a conventional non-woven fabric with abrasive grains. The amount of abrasive grain is properly adjusted since the roller 13 will be ground rather than buffed if the lapping wheel 23 is too hard.

In the first embodiment, the surface of the roller 13 is brought into contact with the peripheral surface of the buffing member 21. The roller 13 is rotated at a speed of 300–450 rpm while the buffing member 21 is rotated at a speed of 1500–2000 rpm, the roller 13 and buffing member 21 being rotated in the same direction so that the surfaces of the roller 13 and buffing member 21 running in opposite directions at the contact point.

Figure 5:
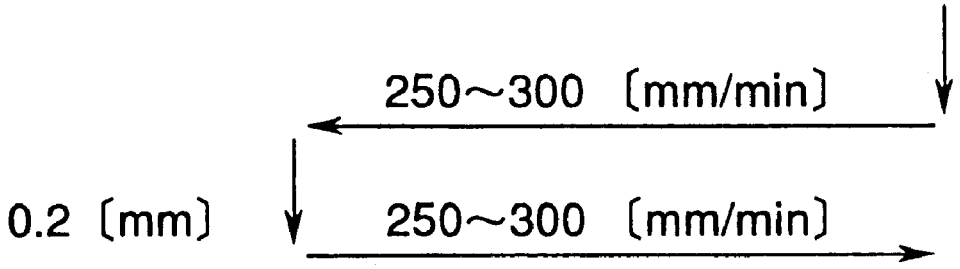
FIG. 5 shows how the developing roller is ground by a fiber polishing material.
Figure 11:
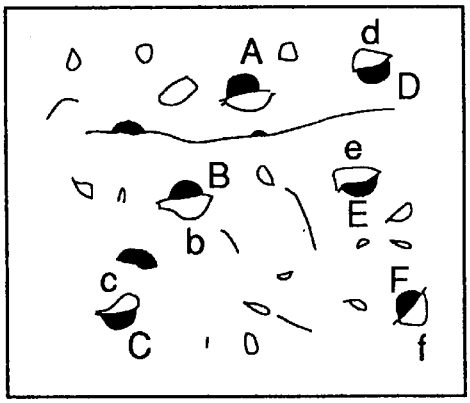
FIG. 11 PRIOR ART
FIG. 11 illustrates the surface of a conventional developing roller.

FIG. 5 shows how the developing roller is ground by the buffing member. As shown in FIG. 5, the buffing member 21 is pressed against the roller 13 with a predetermined grain depth of cut and then moved leftward along the length of the roller 13 at a speed of 250–300 mm/min. Subsequently, the buffing member 21 is pressed against the roller 13 with a depth of cut of 0.2 mm, smaller than the predetermined depth of cut, and is moved rightward along the length of the roller 13 at a speed of 250–300 mm/min.

The lapping wheel 23 is a fiber disc having an outer diameter of 310 mm and an inner diameter of 20 mm, and has abrasive grain S, grade of ultra-fine, and finished surface roughness of #600–800.

Figure 7:
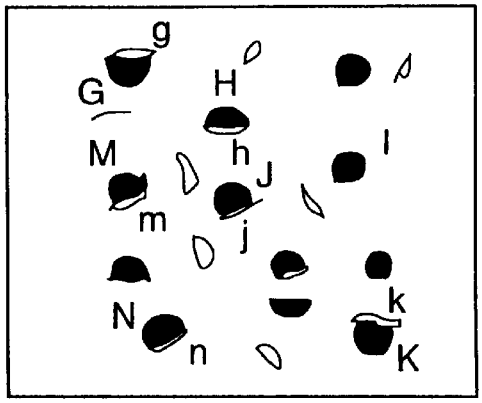
FIG. 7 illustrates the surface of a developing roller of the invention.
Figure 6A:
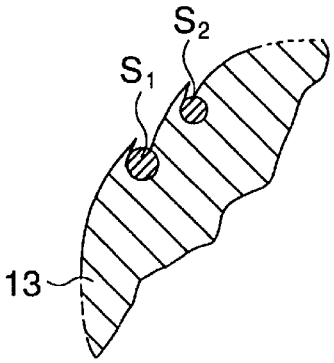
FIGS. 6A–6C illustrate two silicone balls S1 and S2 partially covered with the matrix.
Figure 6B:
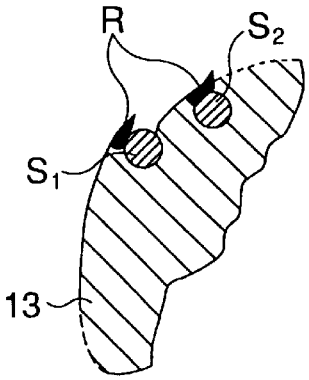
Figure 6C:
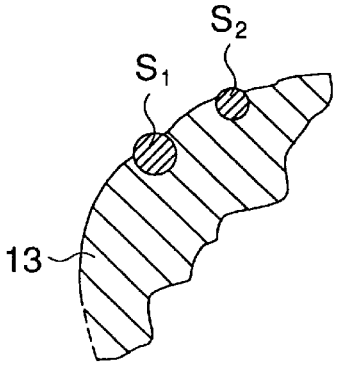

FIGS. 6A–6C are partial transverse cross-sectional views of the roller 13 and illustrate how the buffing effectively removes matrix material covering the silicone balls. FIG. 6A shows two silicone balls S1 and S2 partially covered with the matrix. The matrix covering the two silicone balls S1 and S2 is removed at R by buffing as shown in FIG. 6B. Buffing operation does not, attack to deeply cut into the surface of the developing roller but scratches only the surface or the developing roller. Therefore, it will remove only thin layer of rubber matrix that partially covers the silicone balls and the silicone balls will not come off the developing roller. FIG. 6C shows two exposed silicone balls when the matrix covering them has been removed. The exposed silicone balls S1 and S2 increase the surface roughness of the roller 13. FIG. 7 illustrates the surface of the roller 13 after buffing. As is clear from FIG. 7, it is to be noted that more number of silicone balls G–K and M–N appear on the surface of the roller 13 with larger exposed areas of the silicone balls and smaller covered areas g–k and m–n. The buffing operation effectively removes the matrix material softer than the silicone balls, allowing a sufficient amount of silicone balls to appear on the surface of the roller 13. Thus, the exposed silicone balls occupy larger areas in the present invention than in the prior art, representing a larger percentage of the total surface area of the roller 13.

The sufficient amount of silicone balls appearing on the surface of the developing roller 13 provides adequate surface roughness of the developing roller which in turn holds a correspondingly larger amount of toner during printing operation. The average diameter of silicon balls is about 12 μm and the average diameter of toner particles is about 7 μm. It is expected that the finer the silicon balls are, higher the resolution of the printed image is. However, diameters of silicon balls less than 10 μm cause cohesion of the silicon balls and therefore the average diameter of 12 μm is employed in the present invention.

Thus, the same print density is still maintained after printing operations of, for example, 5,000 pages.

Figure 8:
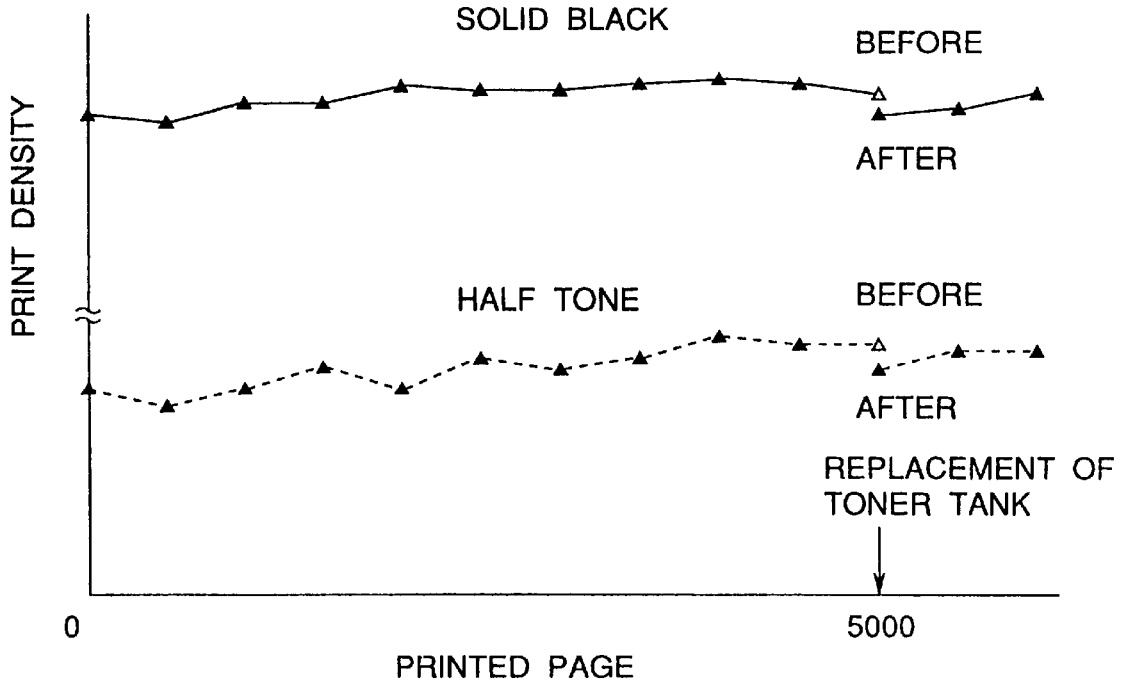
FIG. 8 illustrates changes in print density when printing operation is performed using the developing roller of the first embodiment.

FIG. 8 illustrates changes in print density when printing operation is performed using the developing roller of the first embodiment. FIG. 8 plots the number of pages as the abscissa and density as the ordinate, and shows density changes for solid black pattern and half-tone pattern.

As shown in FIG. 8, it is clear that a developing roller which has been buffed after abrasive finishing results in little or no difference in print density between earlier printed pages and pages after 5,000 pages have been printed. It should also be noted that there is little or no difference in print density between before and after the toner tank and developing roller 13 are replaced.

Buffing removes minute projections on the surface of the roller 13 and makes the projections unnoticeable, achieving the specified surface roughness of Rz-6–10 $\mu$m.

The use of a developing roller having a buffed surface, eliminates inclined lines in printed solid black patterns, which would otherwise appear.

Second embodiment

Figure 9:
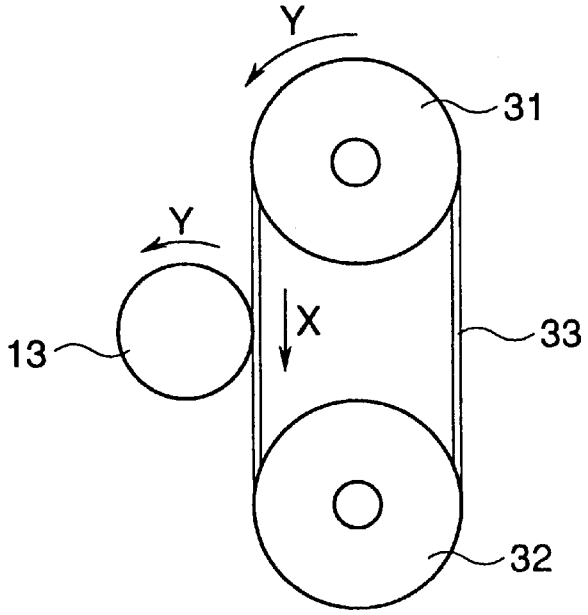
FIG. 9 is a side view showing the roller 13 being polished by a burring mechanism.

FIG. 9 is a side view showing the roller 13 being polished by a buffing mechanism. Referring to FIG. 9, a belt-shaped buffing fabric 33 runs on a drive roller 31 and a driven roller 32 in a direction shown by arrow X. The buffing fabric 33 is formed by impregnating a conventional unwoven fabric with abrasive grains.

The roller 13 is rotated with the surface of the roller 13 in contact with the surface of the buffing fabric 33. The buffing fabric 33 runs while moving along the length of the roller 13, thereby performing buffing operation on the surface of the roller 13.

The roller 13 and drive roller 31 are rotated in the same direction shown by arrow Y so that the surface of the buffing fabric 33 and the surface of the roller 13 run in opposite directions at their contact point.

Third embodiment

Figure 10:
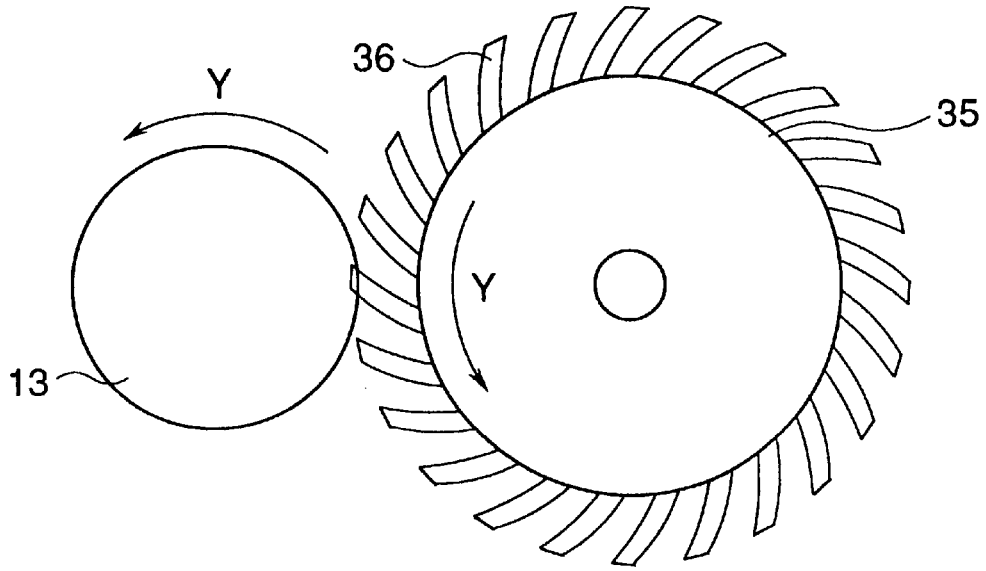
FIG. 10 is a side view showing the roller being buffed by a buffing mechanism.

FIG. 10 is a side view showing the roller 13 being buffed by a buffing mechanism.

Referring to FIG. 10, a plurality of strips of fabric 36 arc fixed to the surface of the roll er 35. The buffing fabric 36 is formed by impregnating a conventional unwoven fabric with abrasive grains.

The roller 13 is rotated in a direction shown by arrow Y with the buffing fabric 36 pressed against the surface of the roller 13. The buffing fabric 36 is rotated in a direction shown by arrow Y while the roller 35 is moved along the length of the roller 1.3 in a direction perpendicular to the page of FIG. 8, thereby performing buffing operation of the surface of the roller 13.

The roller 13 and buffing fabric 36 are rotated in the same direction so that the surface of the roller 13 and the surface of the buffing fabric 36 run in opposite directions at a contact point.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing a developing roller formed of a silicone rubber with powdered silicone balls mixed therein, the method comprising the steps of:

performing an abrasive finishing on the surface of the developing roller by moving a grinding wheel along the length of the developing roller which has been subjected to a secondary vulcanization, the grinding wheel and the developing roller being caused to rotate; and performing a buffing on the ground surface of the developing roller by moving a buffing member along the length of the developing roller while also causing a part of the buffing member contacting the surface of the developing roller to move relative to the developing roller in a peripheral direction of the developing roller, thereby causing more of the powdered silicone balls to appear on the surface of the developing roller.

2. The method according to claim 1, wherein the grinding wheel and the developing roller are rotated in a same direction.

3. The method according to claim 1, wherein said part of the buffing member is moved in a direction opposite to a peripheral direction in which the surface of the developing roller moves.

4. The method according to claim 3, wherein the buffing member and the developing roller are rotated in a same direction, and said part of the buffing member moves in a peripheral direction.

5. The method according to claim 3, wherein said part of the buffing member moves linearly.

* * * * *